US005348180A

United States Patent [19]

Shepard

[11] Patent Number: 5,348,180

[45] Date of Patent: Sep. 20, 1994

[54] CONTAINER HAVING A TAMPER-EVIDENT SEAL

[75] Inventor: John K. Shepard, Bolingbrook, Ill.

[73] Assignee: Sonoco Products Company, Hartsville, S.C.

[21] Appl. No.: 150,839

[22] Filed: Nov. 12, 1993

[51] Int. Cl.[5] ..... B65D 53/00

[52] U.S. Cl. ..... 220/214; 206/807

[58] Field of Search ..... 220/214; 206/807

[56] References Cited

U.S. PATENT DOCUMENTS

| | | | |
|---|---|---|---|
| 1,105,710 | 8/1914 | Stewart | 220/214 |
| 1,316,767 | 9/1919 | Christ | 220/214 X |
| 3,979,016 | 9/1976 | Frater | 220/315 |
| 4,396,113 | 8/1983 | Gail et al. | 220/214 X |

FOREIGN PATENT DOCUMENTS

| | | | |
|---|---|---|---|
| 2102349 | 2/1983 | United Kingdom | 220/214 |

*Primary Examiner*—William I. Price
*Attorney, Agent, or Firm*—Bell, Seltzer, Park

[57] ABSTRACT

A container, suitable for receiving and shipping various products, includes a hollow body member and a removable cover positioned on an open upper end of the body member and has a tamper-evident seal device connecting the body member and the cover to evidence any premature removal of the cover. The seal device includes two sets of superimposed apertures extending through the body member and the cover, a closed sealing wire or member extending through the sets of apertures and around respective inside and outside portions of the body member and cover between the sets of apertures and being sealed to form a closed loop. A patch member is secured to the inside surface of the body member and covers the apertures to prevent contaminants from entering the container through the apertures and to strengthen the area of the body member having the apertures. The patch member preferably defines a guided passageway between the apertures so that the sealing wire may be inserted through one set of the apertures, guided through the passageway and passed out through the other set of the apertures.

4 Claims, 2 Drawing Sheets

CONTAINER HAVING A TAMPER-EVIDENT SEAL

FIELD OF THE INVENTION

This invention relates to a container which may be used for receiving and shipping various products and which has a tamper-evident seal feature.

BACKGROUND OF THE INVENTION

In shipping a variety of products including pharmaceutical products, containers are utilized which are often constructed of a single material, for example paper, plastic or the like, for purposes of recycling. These containers are often in the shape of a drum having a slip-over type cover which telescopes onto an open upper end of the drum. However, these containers may also include boxes or other shaped containers, either with removable lids or with recloseable flaps. Usually, the only tamper-evident feature utilized with this type of container was a tape secured around the container and over the cover, lid or flap for holding the cover, lid or flap on the body portion of the container.

OBJECT AND SUMMARY OF THE INVENTION

Therefore, it is the object of this invention to provide a container of the type discussed above with an effective, low cost, tamper-evident means therein.

By this invention it has been found that the above object may be accomplished by providing a container suitable for receiving and shipping various products and which includes a hollow body member having a side wall and a bottom wall connected together, and a removable or recloseable cover means in the form of a cover, lid or flap member having a top wall and a side wall positioned on an upper end of the body member so that the side wall of the cover member is superimposed on the side wall of the body member.

The container further includes the improvement of tamper-evident seal means connected between the body member and the cover means for sealing such members together and for evidencing any premature removal of the cover means. Such tamper-evident seal means comprises two sets of superimposed apertures extending through the side walls of the body member and the cover means, a closed sealing wire in the forth of a suitable metal, plastic or the like member extending through the sets of superimposed apertures and around respective inside and outside portions of the side walls of the body member and the cover member between the sets of apertures and being sealed to form a closed loop, and a patch means secured to an inside surface of the body member and covering the apertures in the body member to prevent contaminants from entering the container through the apertures and to strengthen the area of the body member having the apertures therethrough.

Preferably, the patch means includes a portion unsecured to the inside surface of the body member and extending between the apertures to define a guided passageway between the apertures so that the sealing wire may be inserted through one set of the apertures and guided through the passageway and passed out through the other set of the apertures. It is also preferable to construct the body member, the cover means and the patch means of like material, such as plastic, paper or the like.

BRIEF DESCRIPTION OF THE DRAWINGS

Some of the objects and advantages of this invention having been set forth, other objects and advantages will appear in connection with a detailed description of this invention to be given in conjunction with the attached drawings, in which.

DETAILED DESCRIPTION OF PREFERRED EMBODIMENT OF THE INVENTION

Figure 1:
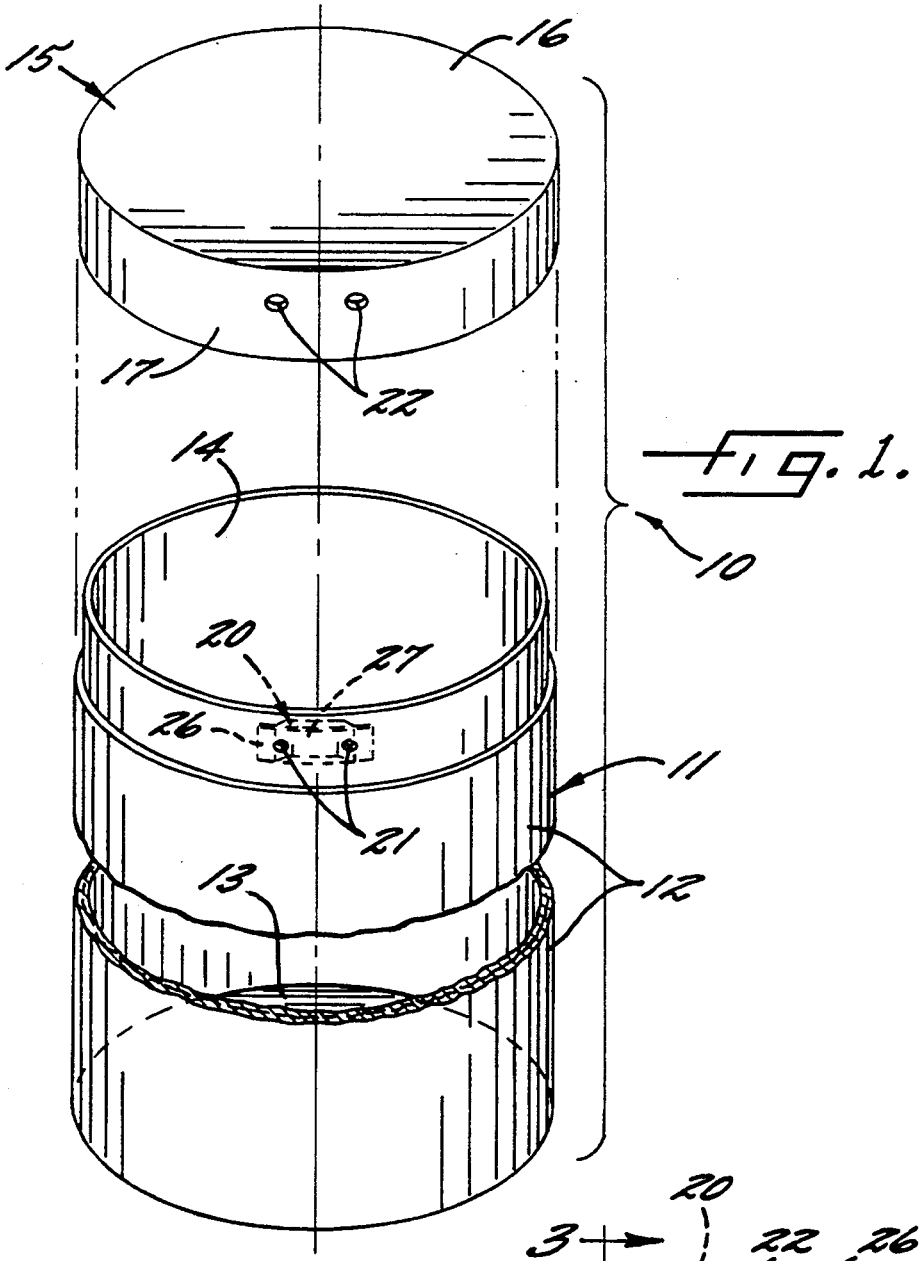
FIG. 1 is an exploded, partial, perspective view of a container including a body member and a cover member and having the tamper-evident feature of this invention.
Figure 2:
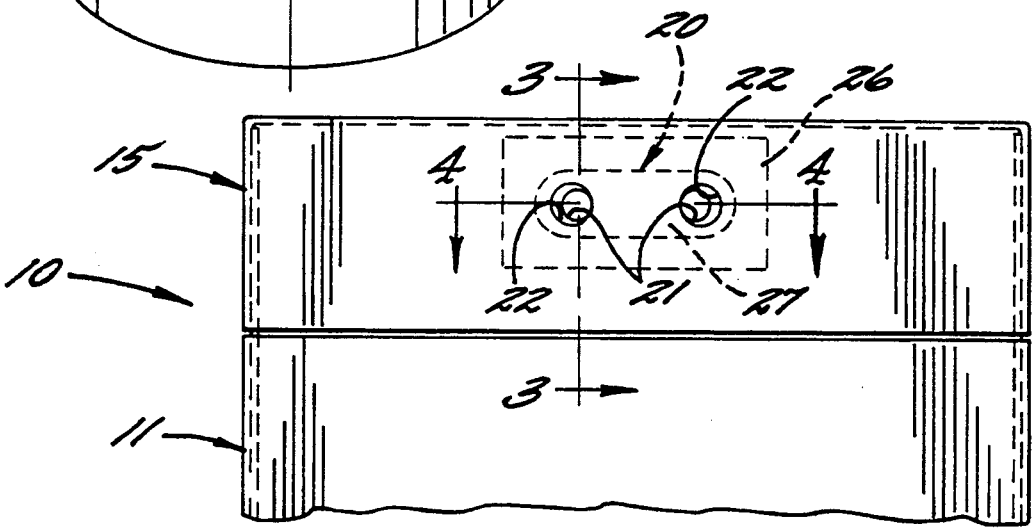
FIG. 2 is an enlarged elevational view of the container of FIG. 1 with the cover member in position on the body member of the container.
Figure 3:
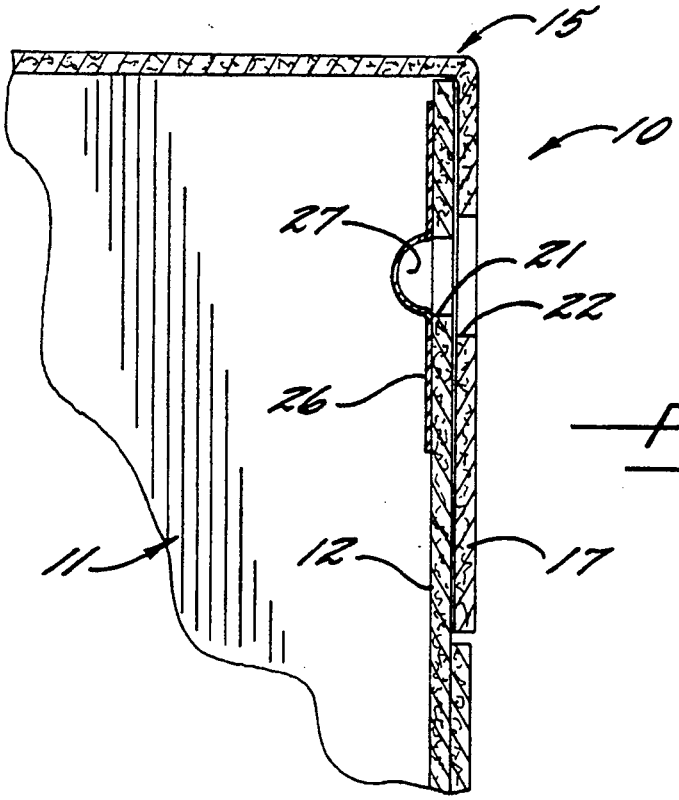
FIG. 3 is an enlarged sectional view taken generally along the line 3—3 of FIG. 2.

Referring now to the drawings, a partial exploded view of a container 10 suitable for receiving various products is illustrated in FIG. 1. This container includes a hollow body member 11 having a side wall 12 and a bottom wall 13 connected together. The container 10 further includes a removable cover member 15 having a top wall 16 and a side wall 17. The removable cover member 15 is adapted to be telescopingly positioned on an open upper end 14 of the body member 11 so that the side walls 17 and 12 are superimposed on each other. The body member 11 and the cover member 15 may be constructed of any suitable material, such as paper, plastic or the like and may be of any suitable size and shape. In the drawings, the body member 11 is shown to be of drum shape and the cover member is of complimentary shape. However, as set forth above, the container may also be in other shapes including a box having a removable lid or recloseable flap.

Figure 5:
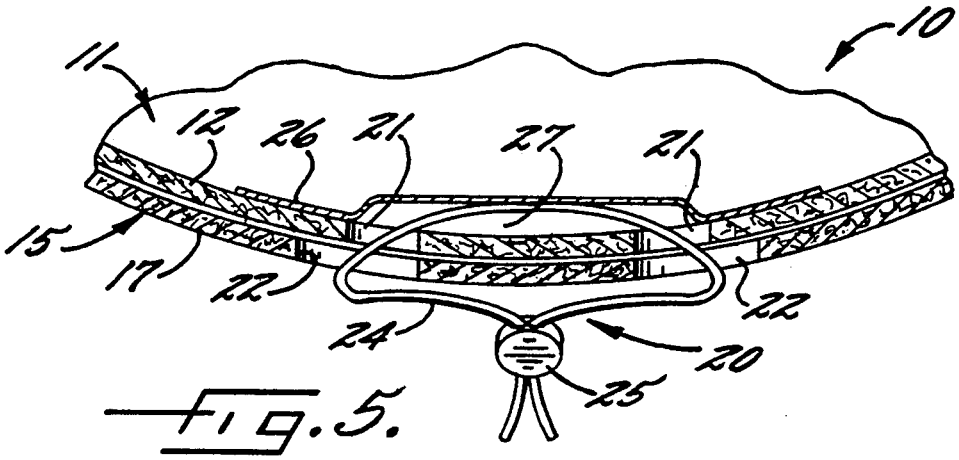
FIG. 5 is a view like FIG. 4 with the sealing wire in place and sealed into a closed loop.

The container 10, in accordance with this invention, includes a tamper-evident seal means which is shown in its entirety in FIG. 5 and generally referred to by the reference numeral 20. This tamper-evident seal means 20 is connected between the body member 11 and the cover member 15 for sealing the members together and for evidencing any premature removal of the cover member 15. The tamper-evident seal means 20 includes two sets of spaced-apart superimposed apertures 21 and 22 extending respectively through the side walls 12, 17 of the body member 11 and the cover member 15 of the container 10. A closed sealing wire 24 extends through the sets of superimposed apertures 21, 22 and around respective inside and outside portions of the side walls 12, 17 of the body member 11 and the cover member 17 between the sets of apertures 21, 22, as may be seen particularly in FIG. 5, and is sealed by a suitable seal member to form a closed loop. This sealing "wire" may be in the form of a metal wire or it may be in the form of an elongated plastic or the like member. Thus, if the cover member 15 is removed from the body member 11 the seal 15 and/or sealing wire 24 must be broken to evidence tampering with the container The tamper-evident seal means 20 further includes a patch member 26 secured to an inside surface of the side wall 12 of the body member 11 and is of sufficient size to cover the apertures 21 in the body member 11 to prevent contaminants from entering the interior of the body member 11 of the container through such apertures. This patch member 26 also acts to strengthen the area of the side wall 12 of the body member 11 which includes the apertures 21 and is somewhat weakened by such apertures 21.

Figure 4:
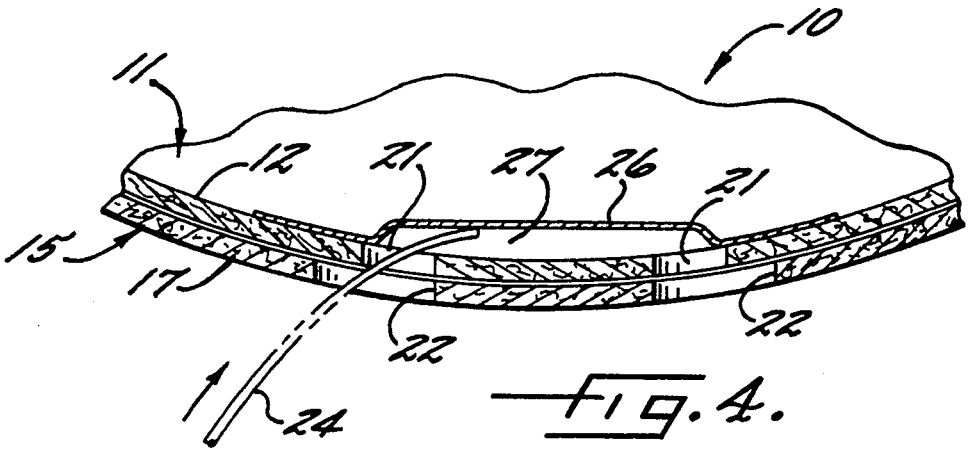
FIG. 4 is an enlarged sectional view taken generally along the line 4–4 of FIG. 2 and further illustrating a sealing wire being inserted through the tamper-evident means of this invention.

Preferably, the patch member 26 includes a portion unsecured to the inside surface of the side wall 12 of the body member 11 and extending between the apertures 21 to define a guided passageway 27 between the apertures 21 so that the sealing wire 24 can be inserted through one set of the apertures 21, 21, guided through the passageway 27 and passed out through the other set of the apertures 21, 22, as may be seen in FIGS. 4 and 5. The patch member 26 is preferably formed of like material, such as paper, plastic or the like, as is the body member 11 and cover member 15 of the container 10 and may be secured by any suitable adhesive or the like which is compatible with these materials.

By this invention, it may be seen that a cost effective, simple, improved tamper-evident seal means 20 is provided between the cover means 15 and the body member 11 of a container 10 which also includes a novel patch member 26 secured on the inside of the container 10 to prevent contaminants from entering the container 10 through the seal means 20 and which provides a reinforcement to the container 10 at the area of the seal means 20 and, preferably, provides a guided passageway 27 for insertion of a sealing wire 24 forming a part of the sealing means 20.

In the drawings and specification, a preferred embodiment of this invention has been illustrated and described, and although specific terms are employed, they are used in a generic and descriptive sense only and not for purposes of limitation.

What is claimed is:

1. In a container suitable for receiving and shipping various products and which includes a hollow body member having a side wall and a bottom wall connected together, and a removable cover means having a top wall and a side wall positioned on an open upper end of said body member so that said side wall of said cover means is superimposed on said side wall of said body member; the improvement of:

tamper-evident seal means connected between said body member and said cover means for sealing said body member and said cover means together and for evidencing any premature removal of said cover means and comprising two sets of superimposed apertures extending through said side walls of said body member and said cover means, a closed sealing wire extending through said sets of superimposed apertures and around respective inside and outside portions of said side walls of said body member and said cover member between said sets of apertures and being sealed to form a closed loop, and a patch means secured to an inside surface of said body member and covering said apertures in said body member to prevent contaminants from entering said container through said apertures and to strengthen the area of said body member having said apertures therethrough.

2. In a container, as set forth in claim 1, in which said patch means includes a portion unsecured to the inside surface of said body member and extending between said apertures to define a guided passageway between said apertures so that said sealing wire may be inserted through one set of said apertures and guided through said passageway and passed out through the other set of said apertures.

3. In a container, as set forth in claim or 2, in which said body member, said cover member and said patch means are constructed of like material.

4. In a container, as set forth in claim 1 or 2, in which said container comprises a drum and said cover means comprises a slip-over cover telescopingly positioned on said open end of said drum.

* * * * *

UNITED STATES PATENT AND TRADEMARK OFFICE

CERTIFICATE OF CORRECTION

PATENT NO. : 5,348,180

DATED : September 20, 1994

INVENTOR(S) : John K. Shepard

It is certified that error appears in the above-identified patent and that said Letters Patent is hereby corrected as shown below:

ON THE COVER PAGE: Col. 1, under Foreign Patent Documents,

The Attorney's name: "Bell, Seltzer, Park" should be -- Bell, Seltzer, Park & Gibson --.

Column 1, line 47, "forth" should be -- form --.

Column 2, line 61, after "member" insert -- 25 --.

Column 2, line 66, after "container" insert -- 10 --.

Column 3, line 4, after "container" insert -- 10 --.

Column 3, line 14, "21, 21" should be -- 21, 22 --.

UNITED STATES PATENT AND TRADEMARK OFFICE

CERTIFICATE OF CORRECTION

PATENT NO. : 5,348,180
DATED : September 20, 1994
INVENTOR(S) : John K. Shepard

It is certified that error appears in the above-indentified patent and that said Letters Patent is hereby corrected as shown below:

Column 4, line 33, after "claim" insert -- 1 --.

Signed and Sealed this

Twenty-second Day of November, 1994

*Attest:*

Bruce Lehman

BRUCE LEHMAN

*Attesting Officer*

*Commissioner of Patents and Trademarks*